United States Patent [19]

Allred et al.

[11] Patent Number: 4,594,973

[45] Date of Patent: Jun. 17, 1986

[54] CROSS HEAD FOR INTERNAL COMBUSTION ENGINE

[75] Inventors: David Allred, Troy; Erwin Eichen, West Bloomfield; James Flasck, Rochester, all of Mich.

[73] Assignee: Energy Conversion Devices, Inc., Troy, Mich.

[21] Appl. No.: 748,281

[22] Filed: Jun. 24, 1985

[51] Int. Cl.[4] ..... F01L 1/18

[52] U.S. Cl. ..... 123/90.40; 123/90.39; 428/627; 428/632; 29/156.7 R

[58] Field of Search ..... 428/627, 632; 123/90.39, 90.4; 29/156.7 R, 156.7 B

[56] References Cited

U.S. PATENT DOCUMENTS

| | | | |
|---|---|---|---|
| 2,380,051 | 7/1945 | Kettering | 123/90.4 |
| 2,385,959 | 10/1945 | Yingling | 123/90.4 |
| 2,939,442 | 6/1960 | Dornbos et al. | 29/156.7 B |
| 2,999,309 | 9/1961 | Kuzmick et al. | 428/627 |
| 3,152,871 | 10/1964 | Matchen | 428/627 |
| 3,640,689 | 2/1972 | Glaski et al. | 428/627 |
| 3,690,958 | 9/1972 | Thompson | 123/90.4 |
| 3,951,612 | 4/1976 | Gates et al. | 428/627 |
| 4,147,074 | 4/1979 | Noguchi et al. | 129/90.39 |
| 4,182,299 | 1/1980 | Earle et al. | 29/156.7 R |
| 4,401,726 | 8/1983 | Gnanamuthu | 29/156.7 A |
| 4,465,040 | 8/1984 | Pelizzoni | 29/156.7 R |
| 4,476,824 | 10/1984 | Reinke et al. | 123/90.39 |
| 4,485,150 | 11/1984 | Tsuno | 428/632 |
| 4,485,770 | 12/1984 | Saka et al. | 123/90.39 |
| 4,503,130 | 3/1985 | Bosshart et al. | 428/632 |
| 4,532,190 | 7/1985 | Kanbe et al. | 428/632 |

FOREIGN PATENT DOCUMENTS

| | | | |
|---|---|---|---|
| 1483420 | 5/1971 | Fed. Rep. of Germany | 428/627 |

*Primary Examiner*—Veronica O'Keefe

*Attorney, Agent, or Firm*—Richard M. Goldman

[57] ABSTRACT

Disclosed is a valve cross head adapted for mechanically translating valve opening impulses from the rocker arm of an internal combustion engine to the valve stem of the internal combustion engine. The cross head has a metal body portion and a ceramic wear pad. The ceramic wear pad includes a chemical vapor deposited transition metal film on the surface thereof whereby to permit adhesion thereof by brazing or soldering between the wear pad and the body portion.

4 Claims, 2 Drawing Figures

CROSS HEAD FOR INTERNAL COMBUSTION ENGINE

FIELD OF THE INVENTION

The invention relates to components for internal combustion engines.

BACKGROUND OF THE INVENTION

In an internal combustion engine, thermal energy is released when fuel is burned. This thermal energy is converted into mechanical energy. In a four stroke or four cycle engine, the combustion gases, for example air, either with a separate stream of fuel or premixed, are introduced from intake manifolds through intake valves into the combustion chambers. The combustion gas is compressed in the cylinder between the piston and the top of the cylinder and ignited. Ignition is by heat of compression in the case of a diesel engine, and by an electric spark plug in the case of a gasoline engine. The combustion of the fuel-air mixture pushes the piston down. The piston, acting through a connecting rod, imparts rotary motion to the crank shaft. The spent, burnt gases are then removed from the cylinder through the outlet valve and replaced by fresh combustion mixture so that a new cycle can begin. The energy required for effecting the exhaust stroke is provided by the flywheel.

In a four cycle engine the first stroke is an intake stroke where the inlet valve is open, and the descending piston, draws fresh combustion gases into the cylinder. The second stroke is a compression stroke where the valves, that is the intake valves and the exhaust valves, are closed and the rising piston compresses the combustion gas mixture. The compression ration is from about 5:1 to about 10:1 in the case of a gasoline engine, and from about 14:1 to about 30:1 in the case of a diesel engine. The third stroke is the power stroke. With the valves still closed the combustion gas mixture is ignited and the pressure of the burning gases forces the piston downward. The fourth stroke is the exhaust stroke, in which the exhaust valve is open and the rising piston discharges the spent gases from the cylinder.

Diesel engines differ from gasoline engines in that in a diesel engine air alone is initially injected into the cylinder and compressed to a very high ratio, for example, from 14 to 1 to about 30 to 1. The resulting compression heats the air to a temperature of from about 700° C. to about 1000° C. At the end of the compression stroke, when the air is at a high temperature, a measured quantity of diesel fuel is injected into the cylinder. The injected diesel fuel ignites spontaneously. Spontaneous ignition occurs in approximately 0.1 to 1 millisecond after injection of the diesel fuel. This occurs after the diesel fuel droplets have mixed intimately with the heated air in the combustion chamber and have been heated to their ignition temperature.

As a result of the high pressures and high temperatures encountered in diesel engines, powerful springs are necessary to keep the valves closed during the compression and combustion cycles, and to assure opening of only the intake valves during the inlet cycle and only the exhaust valves during the exhaust cycle.

Moreover, the high temperatures involved place high thermal stresses on the materials of construction of diesel engine internal components.

The opening of the valves is controlled by a cam shaft. An individual cam lifts a tappet, which lifts a push rod. The push rod rotates a pivoted rocker arm which translates the push rod action 180 degrees. The rocker arm action is transmitted to a crosshead, and from the crosshead to a valve stem. The cam shaft has irregularly shaped cams which force the tappet and push rod vertically upward. This pushes the one end of the rocker arm vertically upward and the other end vertically downward onto the valve crosshead. The valve crosshead then forces the valve stem down to open the valve against the force of the valve springs.

The crosshead is a component that transfers the motion of the rocker arm to two valves. The contact area where the the rocker arm contacts the crosshead piece is highly prone to wear. It has been proposed to place a ceramic wear pad on the valve crosshead piece between the valve crosshead piece and the rocker arm whereby to take up the wear. The ceramic wear pad is to be bonded to the crosshead piece. However, commercial ceramic to metal brazing alloys and solders cannot be used to bond the ceramic wear pad to the metallic crosshead piece. This is because the temperatures normally required for bonding the ceramic wear pad to the crosshead piece degrade the crosshead piece.

SUMMARY OF THE INVENTION

According to the invention herein contemplated there is provided a valve crosshead adapted for mechanically transmitting or translating valve opening impulses from the rocker arm to the valve stem of internal combustion engine. The crosshead has a metal body portion and a ceramic wear pad. The ceramic wear pad has a chemical vapor deposited transition metal film on at least one surface. The transition metal film is wettable by low temperature brazing alloys and/or solders, and is adherent to the crosshead piece. The wear pad is brazed to the body portion of the valve crosshead at the brazed surface of the ceramic cross pad. In this way long service life and ease of manufacturing are attained.

THE FIGURES

DETAILED DESCRIPTION OF THE INVENTION

Figure 1:
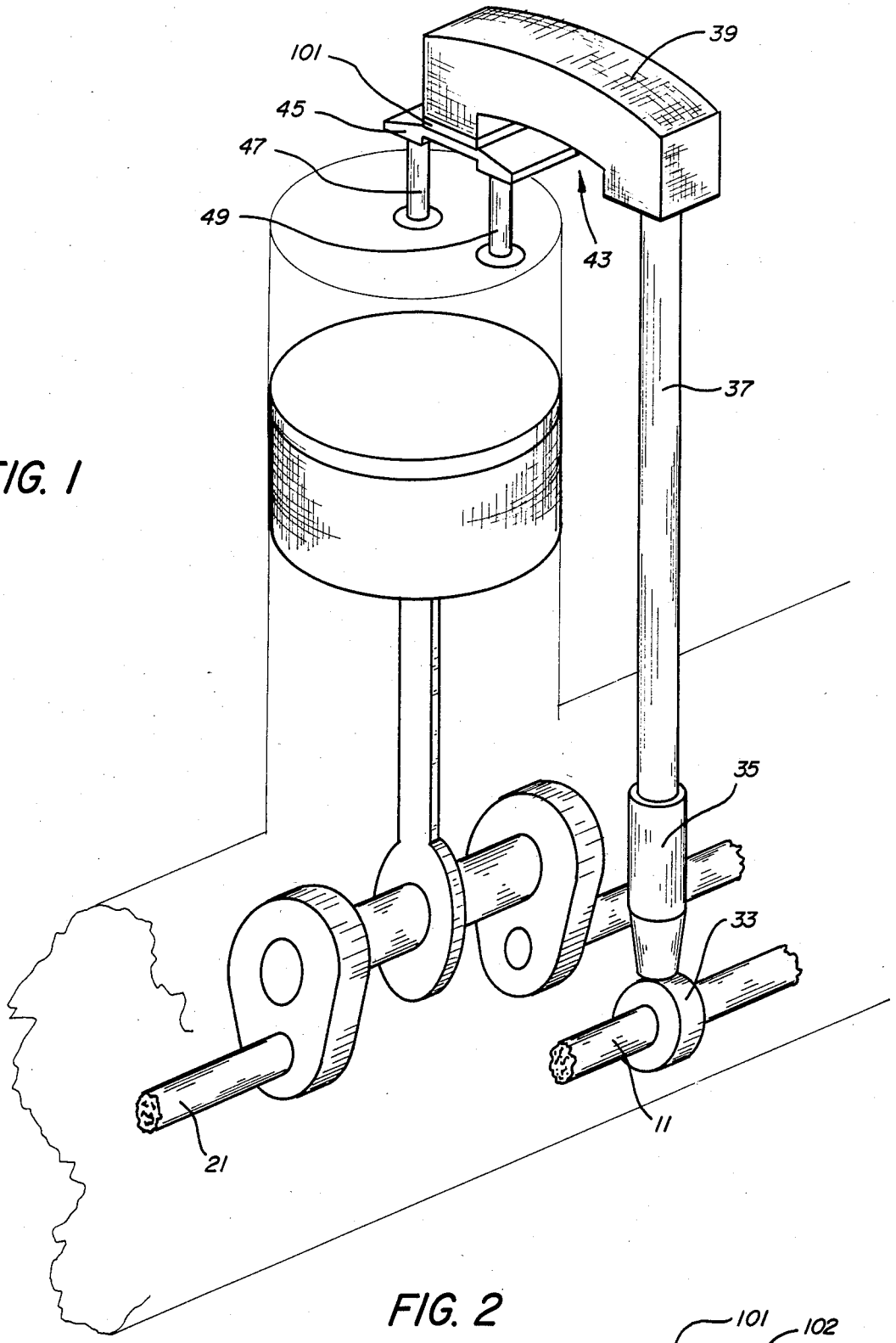
FIG. 1 is a schematic view of an internal combustion engine, especially the valve opening mechanisms thereof.

FIG. 1 shows a schematic view of an internal combustion engine 1 and the valve opening mechanism thereof. A cam shaft 11 in communication with the crank shaft 21 of the internal combustion engine 1 rotates. Individual cams 33 of the cam shaft 21 push the tappets 35 upward. The tappet 35 forces a valve lifter 37 upward to a rocker arm 39. The rocker arm 39 is pivoted at a pivot point 43. The rocker arm 39 translates the upward motion of the valve lifter 37 by 180 degrees and forces the valve crosshead 45 down onto a pair of valve stems 47, 49. At the point of contact between the rocker arm and the valve crosshead is a ceramic wear pad 101.

Figure 2:
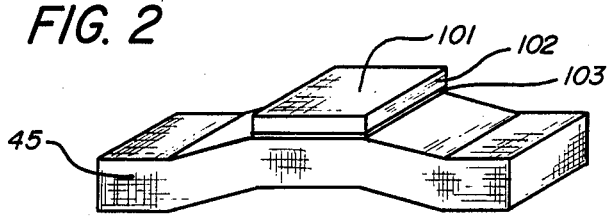
FIG. 2 is a view of the valve crosshead member and ceramic wear pad.

FIG. 2 shows the ceramic wear pad 101. The pad is bonded to the valve crosshead 45 at a brazed or soldered joint 103. The ceramic wear pad 101 has a chemical vapor deposited transition metal film 102 on the surface of the wear pad intended to be bonded, i.e., at bond 103, to the valve crosshead member.

The transition metal may be any transition metal that adheres to the ceramic wear pad 101, and is wettable by soldering or brazing alloys, and may be deposited by chemical vapor deposition. Chemical vapor deposition enhances the adhesion of the film to the wear pad 101, and the wettability of the film material to soldering and brazing alloys. Exemplary are cobalt, nickel, iron, chromium, molybdenum, tungsten, and manganese, as well as combinations thereof.

The chemical vapor deposited transition metal film 102 has a thickness of from about 1 to about 6 microns.

The chemical vapor deposited nickel layer 102 may be deposited from evaporated nickel carbonyl $Ni(CO)_4$, or from cobalt carbonyl nitrosyl $Co(CO)_3NO$. Alternatively, the CVD deposited nickel layer 102 may be deposited by the vacuum sublimation of a solid precursor under conditions that result in chemical vapor deposition onto the substrate, for example, the vacuum sublimation of dicobalt octacarbonyl $Co_2(CO)_8$.

Two basic parameters control the deposition rate and uniformity of films by chemical vapor deposition, including low pressure chemical vapor deposition and atmospherice chemical vapor deposition. These parameters are the rate of mass transfer of reactant gases to the substrate, i.e., the ceramic wear pad 101, and the rate of surface reaction of the reactant gases at the surface. Mass transfer of the gases is believed to involve the diffusion across the slowly moving boundary layer adjacent to the surface of the substrate, i.e., the ceramic wear pad 101. The thinner the boundary layer, the higher the diffusion rate, and the greater the mass transport across the diffusion layer. Surface reaction rates at the surface of the wear pad 101 depend mainly upon the concentration of reactant in the gas stream and the temperature of the wear pad 101. Low pressure chemical vapor deposition of carbonyls enhances the mass transfer and allow high deposition rates and high throughput formation of the chemical vapor deposited brazing layer of the wear pad 101.

When chemical vapor deposition is carried out at atmospheric pressures, the reactants are contained in a carrier gas. The carrier gas is substantially non-reactive under the reaction conditions. Nitrogen is preferred. Atmospheric pressure chemical vapor deposition may be carried out in flow-through reactors.

According to one method of chemical vapor deposition, the chemical vapor deposition of a transition metal is carried out in a tubular furnace having structure for holding the wear pads 101. The chemical vapor deposition apparatus includes a controlled ambient chamber, e.g., a vacuum chamber. Within the chamber is a heater for heating the individual wear pads 101. The temperature of the heater is measured to thermocouple leads going through a metering instrument, such as a Multimeter, to a temperature controller and through a reastat.

In the case of a vacuum chamber, the vacuum chamber is maintained under vacuum by a vacuum pump. Gas, for example nickel carbonyl or cobalt carbonyl nitrosyl, is introduced into the system through gas cylinders. The gas flow rate may be controlled so as to deposit the layer at a desired rate. The chemical vapor deposition system may be a vertical system where the gas flow is vertical or it may be a horizontal system where the gas flow is horizontal.

According to the invention herein contemplated, the temperature range for deposition of the transition metal coating on the ceramic wear pads is as shown in Table 1 below. These temperature ranges provide a particularly high degree of adhesion and particularly desirable properties.

TABLE 1

| Metal | Temperature Range (degrees C.) | Preferred Temperature Range (degrees C.) |
|---|---|---|
| Co | 70–140 | 90–110 |
| Ni | 160–350 | 200–280 |
| Fe | 160–350 | 200–280 |
| Cu | 250–400 | 280–350 |
| Mo | 250–400 | 280–350 |
| W | 250–400 | 280–350 |
| Mn | 160–330 | 200–280 |

In vacuum chemical vapor deposition, the absolute pressure in the vacuum chamber is typically maintained below about 5 torr. In this way, particularly satisfactory results are obtained. Deposition rates utilizing the temperatures and vacuums herein described are on the order of 0.1 micron to about 5 microns per minute, resulting in the build up of a film of about 1 to 6 microns or more in from about 12 seconds to about 20 minutes. After the coated ceramic wear pads are removed from the chemical vapor deposition system, they may be brazed or soldered to the valve cross head.

The ceramic wear pads are formed, for example, of ceramic materials capable of withstanding both the high temperatures typically encountered in diesel engines service and the mechanical forces imposed thereon by the valve springs and the camshaft-tappet-valve lifter-rocker arm system. Such materials include zirconium oxides, aluminum oxides, and silicon nitrides, especially $Si_3N_4$.

The ceramic wear pad generally has a dimension such as to provide a desirable degree of mechanical durability. This is from about $\frac{1}{4}$ inch by $\frac{1}{2}$ inch by 1/16 inch to about 1 inch by about 1 inch by about $\frac{1}{4}$ inch.

Typical brazing and soldering alloys useful in brazing or soldering the metal coated ceramic wear pads 101 to the metallic valve cross head 45 include 95 cadmium-5 silver alloys, zinc-aluminum alloys, zinc-aluminum-copper alloys, and aluminum silicon alloys.

While the invention has been described with respect to certain preferred exemplifications and embodiments thereof, it is not intended to limit the scope of protection thereby but solely by the claims appended hereto.

We claim:

1. A valve cross head adapted for mechanically translating valve opening impulses from the rocker arm to the valve stem of an internal combustion engine; said cross head comprising a metal body portion, a ceramic wear pad, a chemical vapor deposited film of a transition metal wettable by soldering and brazing alloys and adherent to the ceramic wear pad on the surface of the ceramic wear pad, and a bond between the transition metal surface of the ceramic wear pad and the body portion of the valve cross head.

2. The valve crosshead of claim 1 wherein the transition metal is chosen from the group consisting of nickel, iron, chromium, cobalt, molybdenum, tungsten, manganese, and combinations thereof.

3. The valve crosshead of claim 2 wherein the transition metal is nickel.

4. The valve crosshead of claim 1 wherein the transition metal film is from 1 to 6 microns thick.

* * * * *